US007186206B2

(12) United States Patent
Wren

(10) Patent No.: US 7,186,206 B2
(45) Date of Patent: Mar. 6, 2007

(54) THERAPEUTIC METHOD AND DEVICE THEREFOR

(76) Inventor: Gordon R Wren, 311 Huntington Dr., Tempe, AZ (US) 85282

( * ) Notice: Subject to any disclaimer, the term of this patent is extended or adjusted under 35 U.S.C. 154(b) by 651 days.

(21) Appl. No.: 10/056,456

(22) Filed: Jan. 28, 2002

(65) Prior Publication Data

US 2003/0148860 A1 Aug. 7, 2003

(51) Int. Cl.
*A63B 71/00* (2006.01)

(52) U.S. Cl. ..... 482/148; 446/220

(58) Field of Classification Search ..... 482/148; 446/220; 40/110, 905
See application file for complete search history.

(56) References Cited

U.S. PATENT DOCUMENTS 2,632,977 A * 3/1953 Valasek ..... 446/325
4,268,030 A * 5/1981 Richards ..... 482/85
4,725,462 A * 2/1988 Kimura ..... 428/29
4,826,550 A * 5/1989 Shimizu et al. ..... 156/166
4,917,643 A * 4/1990 Hippely et al. ..... 446/14
5,011,445 A * 4/1991 Nakasuji et al. ..... 446/14
D330,396 S * 10/1992 Barnes ..... D21/635
5,375,271 A * 12/1994 Frankel ..... 4/581
5,501,601 A * 3/1996 Todokoro et al. ..... 434/169
5,503,583 A * 4/1996 Hippely et al. ..... 446/14
5,674,157 A * 10/1997 Wilkinson ..... 482/83
5,781,941 A * 7/1998 Radke et al. ..... 4/583
5,786,838 A * 7/1998 Steinhauser et al. ..... 347/179
5,961,426 A * 10/1999 Spector ..... 482/83
6,346,024 B1 * 2/2002 Engel ..... 446/14
6,398,616 B1 * 6/2002 Motosko, III ..... 446/220
6,953,345 B1 * 10/2005 Nakashima et al. ..... 434/408
2002/0111109 A1 * 8/2002 Kwan ..... 446/220

* cited by examiner

*Primary Examiner*—Lori Amerson

(57) ABSTRACT

A therapeutic device (10) is formed to have an area (11,12, 13) upon which marking instruments (26) may be used to form a design. A subject (25) may use the area to form a design of a person that causes stress to the subject. The subject can express internal feelings toward the design. The design may be removed and the area used by another subject to form a different design.

11 Claims, 2 Drawing Sheets

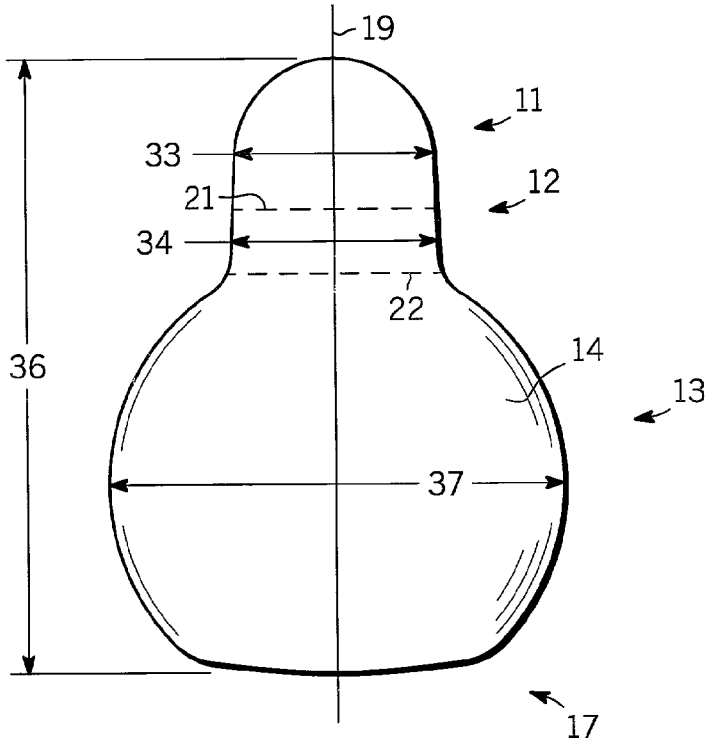
FIG. 1
FIG. 2
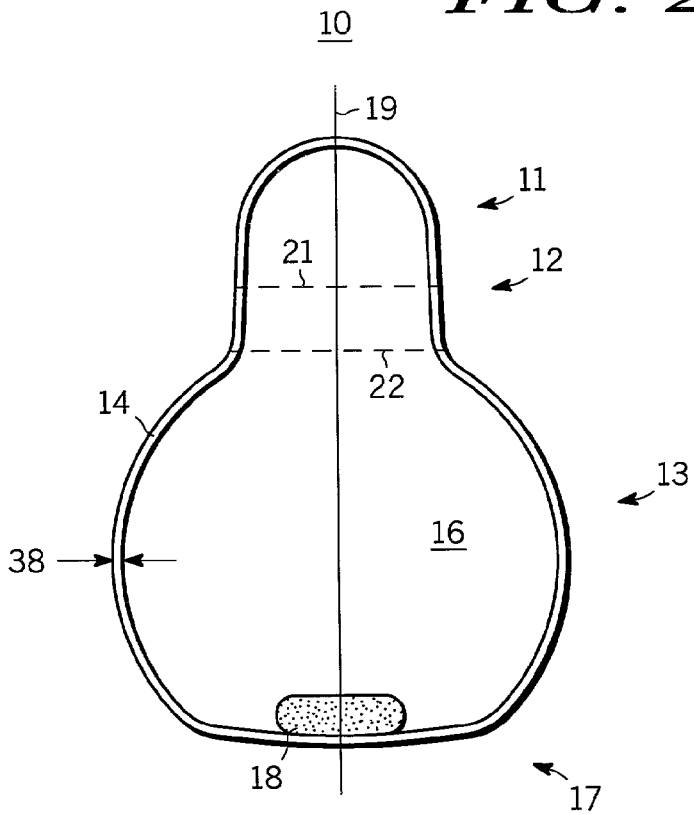

THERAPEUTIC METHOD AND DEVICE THEREFOR

BACKGROUND OF THE INVENTION

The present invention relates, in general, to mental therapy, and more particularly, to a mental therapy method and device.

In the past, the psychological field used various methods and techniques for treating various psychological related problems such as anger, aggression, negative self-image, and powerlessness. One technique currently in use is a bop-bag having an image of a referee silk-screened onto the bop-bag. This is often referred to as THE REF BOP-BAG. The patient is encouraged to relate THE REF BOP-BAG to the source of the patient's psychological related problem. The patient punches the Ref bop-bag to release the patient's anger without causing damage to the individuals with which the patient is angry.

One problem with this method is that the patient often can not relate the patient's feelings to the referee image. A therapist generally attempts to have the patient view THE REF BOP-BAG as the person causing the negative feelings and psychological related problems in the patient. However, the referee figure is not the person at which the patient is angry, thus, THE REF BOP-BAG may not be effective in developing the emotional feelings from the patient that is desired by a therapist.

Accordingly, it is desirable to have a therapeutic method and device that a patient can view as the person with which the patient is angry or the source of the patient's psychological problem and that the patient can use to direct angry feelings in a positive manner.

BRIEF DESCRIPTION OF THE DRAWINGS

FIG. 1 schematically illustrates a reduced image of an embodiment of a therapeutic device in accordance with the present invention;

FIG. 2 schematically illustrates a reduced cross-sectional view of the therapeutic device of FIG. 1 in accordance with the present invention.

For simplicity and clarity of illustration, elements in the figures are not necessarily to scale, and the same reference numbers in different figures denote the same elements. Additionally, descriptions and details of well known steps and elements are omitted for simplicity of the description.

DETAILED DESCRIPTION OF THE DRAWINGS

Figure 3:
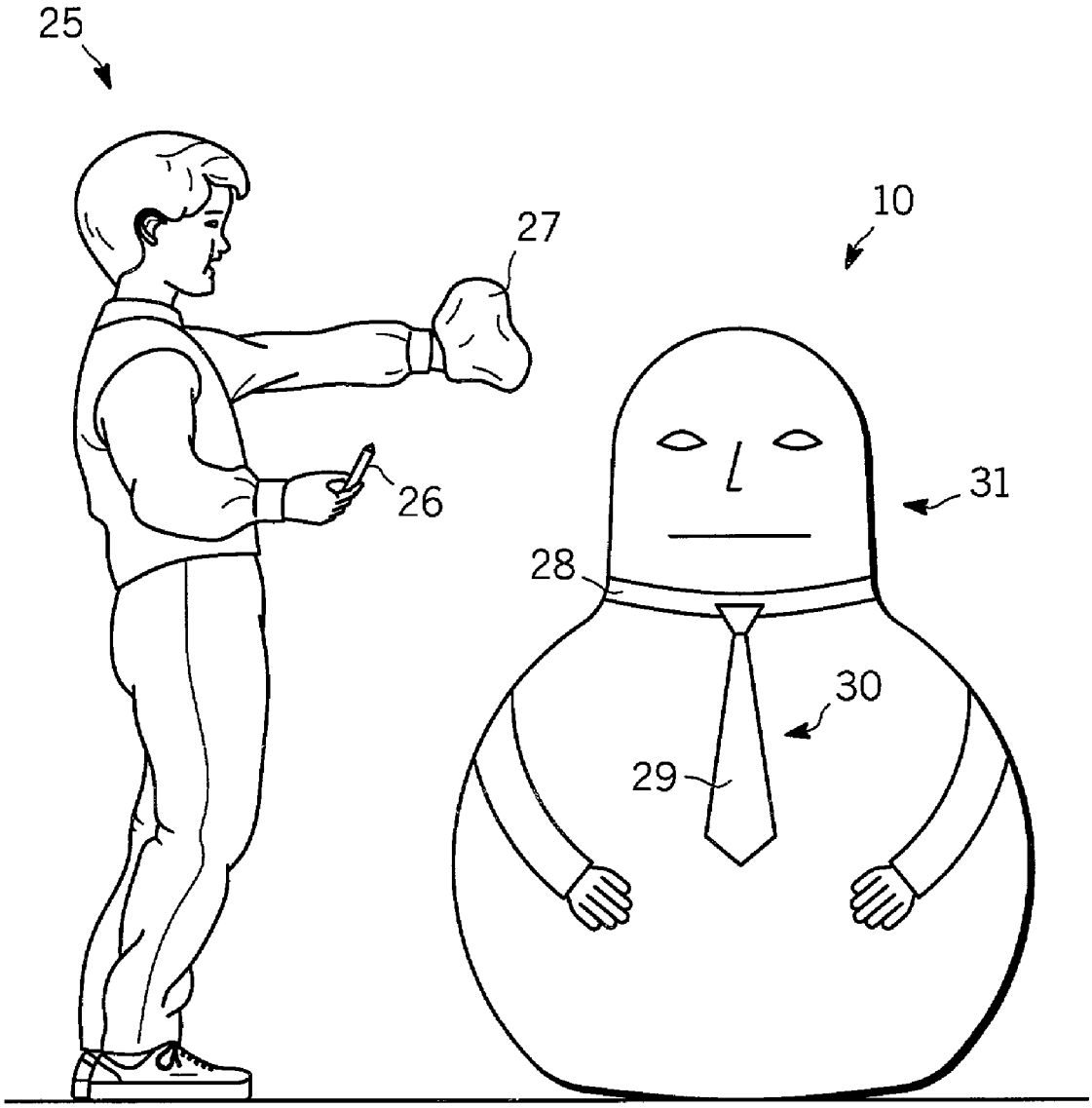
FIG. 3 schematically illustrates the therapeutic device of FIG. 1 with a subject in accordance with the present invention.

The present invention provides a therapeutic device and method that facilitates a subject relating the therapeutic device to a source of the subject's psychological problem.

FIG. 1 illustrates a reduced image of an embodiment of a therapeutic device 10. Device 10 is a hollow bag having a shape that is generally a three dimensional humanoid shape and that is filled to support the shape. Device 10 also has a return that facilitates device 10 rotating around a point that is in contact with a support, such as a floor or the ground. For example, applying a horizontal force to device 10 causes it to rotate about the point or to depart from a vertical position. The return facilitates returning the therapeutic device to an upright position after the horizontal force is removed. A device having such characteristics is often referred to as a bop-bag.

Device 10 has a resilient outer cover 14 that is sufficiently soft that it does not damage a person's fist or other body part especially when device 10 is punched, hit or even jumped on by a person. The material used for cover 14 is sufficiently durable to withstand such frequent impact. Device 10 has a generally humanoid shape and has a head portion, generally denoted by head section 11, a neck portion, generally denoted by neck section 12, and a torso portion, generally denoted by torso section 13. The height 36 of device 10 is selected to be suitable for interaction with children and young adults. Height 36 generally is between approximately ninety-three (93) and one hundred ten (110) centimeters and preferably is about one hundred (100) centimeters. Generally, device 10 is can be viewed as circles of various diameters and vertical displacements such that device 10 is symmetrical about a longitudinal axis 19. Head section 11 generally is above a dashed line 21 and has a diameter 33 that is no greater than a diameter 34 of neck section 12. Diameter 33 typically is between about twenty-two (22) and twenty-eight (28) centimeters. Neck section 12 generally is between dashed lines 21 and 22 and has a diameter 34. Diameter 34 may be no less than diameter 33 and generally is less than a diameter 37 of torso section 13. Generally, diameter 34 is between thirty (30) and thirty-five (35) centimeters and preferably is about thirty-three (33) centimeters. Diameter 37 of torso section 13 is below dashed line 22 and generally is greater than diameters 33 and 34. Diameter 37 typically is between about fifty (50) and sixty (60) centimeters and preferably is about fifty-five (55) centimeters. Diameters 33, 34, and 37 are measured at the widest portions of the respective sections. A base section, generally denoted by reference number 17, is below torso section 13 and supports device 10. Base section 17 assists in providing a self-righting characteristic to device 10 as will be seen in the description of FIG. 2. Dashed lines 21 and 22 are shown for illustration purposes only and generally are not a part of device 10.

It is important that resilient outer cover 14 is formed from a material that is durable and suitable for both marking on cover 14 with marking instruments and then removing the markings from the material. Thus, resilient outer cover 14 also functions as a drawing or writing surface. The material used for resilient outer cover 14 is sufficiently durable to withstand frequent impacts and has a color that facilitates a person seeing any designs that are drawn on resilient outer cover 14. Suitable materials for resilient outer cover 14 include vinyl such as polyvinyl chloride and equivalents thereto. In the preferred embodiment, resilient outer cover 14 is white. Marking instruments (see FIG. 3) that are used for forming a design on resilient outer cover 14 have a marking fluid that is easily removable from cover 14. In the preferred embodiment, the marking instruments use a wet erase marking fluid and have a marking tip that is commonly referred to as a chisel tip. Wet erase fluids generally are easily erased from cover 14 and leave insignificant residue. Chisel tip marking surfaces forms lines that are easier to see than pen-point marking surfaces thereby making the lines easier to see, quicker to form, and create less frustration for the subject. Wet erase fluids and chisel tip marking tips are easily understood by those skilled in the art. It is understood that wet erase also includes damp erasing with a moist sponge, cloth, or equivalent. Different color marking instruments generally accompany or are included with device 10. Different colored marking instruments encourage self-expression of the subject's internal feelings and frustrations by using the different colors to express the feelings in addition to the freedom of forming designs that also express the internal feelings. In the perferred embodiment, five (5) different colored marking instruments are included with device 10.

Any one of or various combinations of head section 11, neck section 12, and torso section 13 may have an area suitable for using the marking instruments for forming designs on and subsequently removing the designs from the respective sections. In the preferred embodiment, all of resilient outer cover 14 is white and devoid or substantially deviod of any printing, inks, or designs formed on resilient outer cover 14 including those that may be formed from silk-screening and other equivalent printing techniques. IT will be understood that the terms substantially devoid as used herein shall mean that a small amount of marking is allowed for trademark, manufacturer identification, and other equivalents. Thus, in the preferred embodiment resilient outer cover 14 includes an area that is devoid of printing and formed to co-operate with marking instruments for forming a design with the marking instrument. In other embodiments, portions of resilient outer cover 14 may have some areas that have printing, however, device 10 always has at least one area that is devoid of printing and formed to co-operate with marking instruments for forming a design with the marking instrument and subsequently removing the design.

FIG. 2 illustrates a reduced cross-sectional view of therapeutic device 10 shown in FIG. 1. Generally, device 10 is hollow with an interior 16 that is inflated to provide some rigidity to the humanoid shape. An inflation valve (not shown) is provided to facilitate inflation of device 10. However, device 10 may also be filled with soft materials to support resilient outer covering 14. Base section 17 has a space 18 for a weight or other equivalent means that facilitates restoring device 10 to a generally upright position after device 10 is displaced from an upright position. Typically, the weight in space 18 is between about 0.9 kilograms and 1.8 kilograms. In the preferred embodiment illustrated in FIG. 3, the weight is a heavy material such as sand or an equivalent that facilitates restoring device 10 to an upright position in a brief period of time. Also in this preferred embodiment, the weight is about 1.3 kilograms. Upon displacing axis 19 from a vertical position, the weight in space 18 tends to restore axis 19 to a generally vertical orientation.

Cover 14 has a thickness 38 that assists in providing sufficient durability for device 10. Typically, thickness 38 is greater than approximately 0.20 millimeters and preferably is about 0.30 millimeters.

FIG. 3 schematically illustrates therapeutic device 10 shown in FIG. 1 with a subject 25. Subject 25 graphically represents a subject that is using device 10. Subject 25 often forms a design on an area of resilient outer covering 14 that is devoid or substantially devoid of printing and formed to co-operate with marking instruments for forming a design. Subject 25 uses a marking instrument 26 to form the design. In the example illustrated in FIG. 3, subject 25 forms a necktie 30 having a first portion 28 on neck section 12 and a second portion 29 on torso section 13. Subject 25 also draws a face 31 on head section 11. After forming the design, a therapist may ask questions of subject 25 to assist subject 25 to release anger by punching device 10. Subsequently, face 31 and necktie 30 are removed from device 10 with a wet erase device 27 so that device 10 may be used by another subject to form other designs.

By now it should be appreciated that there has been provided a novel way to form a therapeutic device. By forming the therapeutic device to have a writeable surface, a subject can relate the therapeutic device to the source of the subject's anger thereby facilitating the subject to release the subject's anger in a positive manner. Focusing the anger release at the therapeutic device instead of a person assists the subject in processing the feelings of anger instead of releasing them on another person or harming another person. Forming the therapeutic device from a durable material facilitates withstanding repeated impacts without damage. Using a heavy weight facilitates more human actions and quicker responses for the subject. Additionally, the writable surface facilitates the subject expressing internal feelings in the drawings and colors used to form the images on the therapeutic device.

While the invention is described with specific preferred embodiments, it is evident that many alternatives and variations will be apparent to those skilled in the arts. More specifically the invention has been described for a particular embodiment of a bop-bag, although the method is directly applicable to other shapes, sizes, and colors.

The invention claimed is:

1. A therapeutic method comprising:

forming a bop-bag having an outer cover; and forming an area on the outer cover that is substantially devoid of printing and co-operative with marking instruments to form a design on the area and co-operative for removing the design.

2. The method of claim 1 further including forming the bop-bag to have a head section, a neck section, and a torso section wherein the torso section has a diameter that is greater than a diameter of the head section and a diameter of the neck section and forming the area on at least one of the group consisting of the head section, neck section, and torso section.

3. The method of claim 1 further including using the bop-bag for mental therapy including forming a design on the area on the outer cover and subsequently removing the design from the outer cover.

4. The method of claim 3 further including using the marking instruments for forming the design.

5. The method of claim 1 further including forming another area on the outer cover by forming the another area having a preprinted marking.

6. A therapeutic method comprising:

forming a bop-bag having a resilient outer cover in a humanoid shape; and forming an area of the resilient outer cover to be substantially devoid of printing and to co-operate with marking instruments for forming a design on the area and for removing the design from the area.

7. The therapeutic method of claim 6 wherein forming the bop-bag includes forming the bop-bag having a head section, a neck section, and a torso section wherein the torso section is wider than either the head section or the neck section.

8. The therapeutic method of claim 7 including forming the area on the head section.

9. The therapeutic method of claim 7 further including using wet erase marking fluid for forming the design on the area.

10. The therapeutic method of claim 7 wherein forming the bop-bag having the resilient outer cover includes forming the bop-bag from polyvinyl chloride having a thickness greater than 0.20 millimeters.

11. The therapeutic method of claim 7 further including forming the bop-bag having a height between ninety-three and one hundred ten centimeters.

* * * * *